US006736712B1

(12) United States Patent
Horn

(10) Patent No.: US 6,736,712 B1
(45) Date of Patent: May 18, 2004

(54) ROTARY SANDING DISK

(75) Inventor: Jerry Horn, Loveland, OH (US)

(73) Assignee: Performance Abrasives Incorporated, Cincinnati, OH (US)

( * ) Notice: Subject to any disclaimer, the term of this patent is extended or adjusted under 35 U.S.C. 154(b) by 0 days.

(21) Appl. No.: 09/306,971

(22) Filed: May 7, 1999

(51) Int. Cl.[7] ..... B24B 23/02
(52) U.S. Cl. ..... 451/359; 451/456
(58) Field of Search ..... 451/359, 353, 451/456, 526, 539, 513, 514, 548, 527, 921, 453, 528, 538

(56) References Cited

U.S. PATENT DOCUMENTS

| | | | | | |
|---|---|---|---|---|---|
| 505,644 | A | * | 9/1893 | Webster | 451/513 |
| 2,127,703 | A | * | 8/1938 | Schwenke | 451/513 |
| 3,186,135 | A | * | 6/1965 | Crean | 451/548 |
| 3,522,681 | A | * | 8/1970 | Lampert | 451/490 |
| 4,058,936 | A | * | 11/1977 | Marton | 451/359 |
| 4,065,882 | A | * | 1/1978 | D'Urso | 451/513 |
| 4,287,685 | A | * | 9/1981 | Marton | 451/514 |
| 4,617,767 | A | * | 10/1986 | Ali | 451/490 |
| 4,622,783 | A | * | 11/1986 | Konig et al. | 451/514 |
| 5,287,662 | A | * | 2/1994 | Weis et al. | 451/527 |
| 5,725,423 | A | * | 3/1998 | Barry et al. | 451/539 |
| 6,223,383 | B1 | * | 5/2001 | Van Putten | 15/230 |

FOREIGN PATENT DOCUMENTS

| | | | | |
|---|---|---|---|---|
| CA | 1078619 | * | 6/1980 | 451/456 |

* cited by examiner

*Primary Examiner*—Robert A. Rose
(74) *Attorney, Agent, or Firm*—Wood, Herron & Evans, L.L.P.

(57) ABSTRACT

A sanding disk for a rotary sander includes an edge which has a plurality of spaced projectionsp. These radially extended projections, preferably in the form of a wave form, facilitate sanding interior radiused surfaces. This sanding disk can be used on a unique pad having an arcuate outer radial edge which further facilitates sanding interior radiused surfaces. The sanding disk may also have a plurality of arcuate slots which are adapted to align with radial holes in the pad of the rotary sander. The radial holes generally communicate a vacuum source.

5 Claims, 2 Drawing Sheets

ROTARY SANDING DISK

Rotary sanders are used for a wide variety of commercial sanding purposes as well as home use. They are particularly useful in the automotive repair industry, in woodworking and in applications such as manufacture of cultured tile surfaces. These rotary sanders use a circular abrasive disk, i.e. sand paper which is attached to a sanding pad which rotates. There may be a suction device to vacuum off dust as it is formed.

To be effective, the abrasive surface of the sand paper must be pressed against the surface being sanded. This presents no problem for generally flat surfaces as well as exteriorly radiused surfaces. However when an interior radius is encountered, the sanding disks do not function well.

The edge of these sanding disks are circular and tend to cut into the interior radius. Because there is inadequate contact between the sand paper and the radiused surface, it fails to sand the surface as desired. Also when attempting to sand an interior radius, the edge of the sandpaper can be torn up which in turn could lead to destruction of the sanding pad.

These sanding pads themselves are circular in design and generally include a plurality of holes that attach to a vacuum source. The holes are aligned in a circle and can be connected to each other with a circular groove in the center portion of the sanding pad. The sanding disks themselves have a plurality of radially spaced holes which are adapted to align with either the holes or the grooves in the sanding pad. However, they are difficult to apply on the pad and properly align the holes in the disk with the holes in grooves in the pad.

SUMMARY OF THE INVENTION

The present invention is premised upon the realization that sanding disks with one edge formed from a plurality of spaced radial protusions will easily sand an inner radius surface.

The present invention comprises a sandpaper disk for a rotary sander which has an edge portion having radially spaced protusions. The sanding disk is designed so these protusions extend beyond the outer edge of the sanding pad and can easily act upon an inwardly radiused surface without gouging the surface or destroying the sandpaper. Preferably the protusions are curved further facilitating contacting inner radiused surface.

Further the present invention is premised on the realization that the sanding disk itself can more easily remove or vacuum dust wherein instead of having a plurality of radially spaced holes, a plurality of space arcuit grooves are employed. The grooves are spaced so that they do not create a radial imbalance in the sanding disk. This greatly facilitates vacuuming of material.

The present invention will be further appreciated in light of the followed detailed descriptions and drawings.

DETAILED DESCRIPTION

Figure 1:
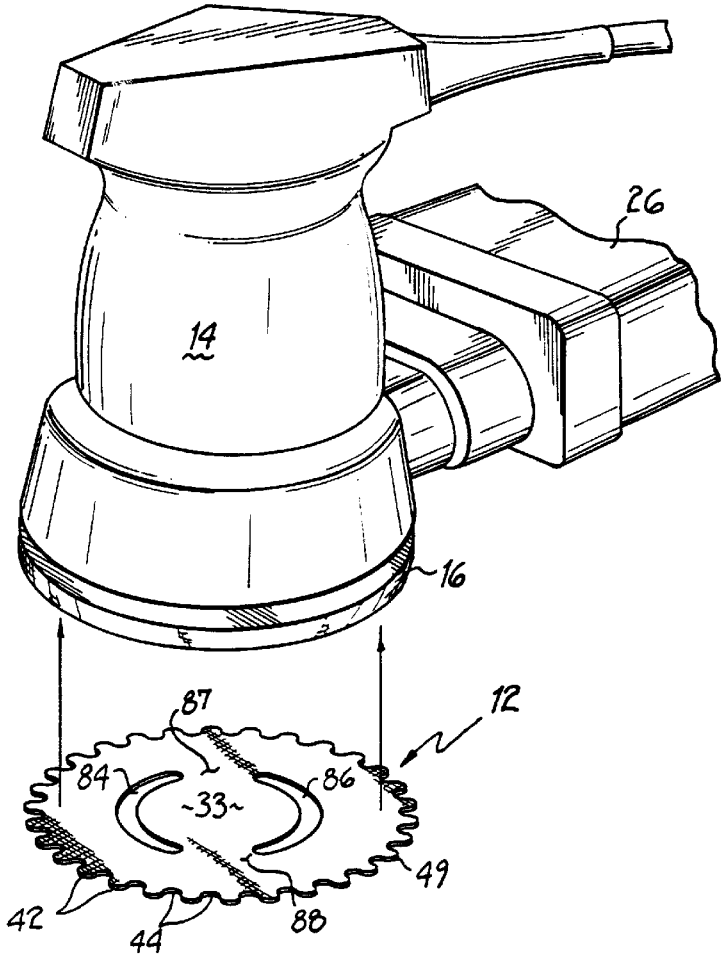
FIG. 1 is a perspective view of a rotary sander with a sanding disk being applied.
Figure 2:
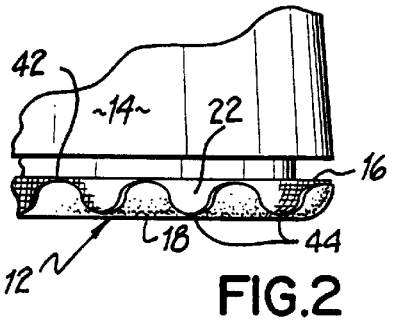
FIG. 2 is a side plan view of a rotary sander, broken away in combination with a sanding disk.
Figure 4:
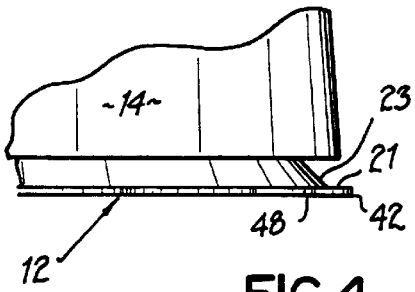
FIG. 4 is a cross-sectional view broken away of a sanding disk of the present invention on a prior art sanding pad.

As shown in FIG. 1, the present invention is a sanding disk 12 which is designed for use on a rotary sander 14. The rotary sander shown in FIG. 1 includes a sanding pad 16 which has a central flat portion 18 and as shown an arcuate edge 22. Alternately as shown in FIG. 4 the sanding pad 21 can have a straight or inwardly beveled edge 23. A plurality of radially spaced holes 24 are located in the central plat portion 18 and lead to vacuum line 26. Connecting the holes 24 is an annular groove 28.

The sanding disk 12 has an abrasive surface 32 and an opposite backside 33 which is adapted to bond to the pad 16 (or 21) of sander 14. This can be a variety of different surfaces such as a pressure sensitive adhesive surface or a felt surface where the sanding pad is a hook-type material similar to a hook and pile fasteners. Alternately the disk can be held to the sander by a central bolt.

The sanding disk 12 includes a central portion 36 and an edge portion 38. The edge portion includes a plurality of arcuate projections or peaks 42 separated by arcuate valleys 44. Generally the bottom edge of the valleys (shown by dotted line 48) is designed to lie along the outer edge 49 of the disk immediately prior to the arcuate edge 22. In that manner the arcuate projections 42 extend freely beyond the edge of the pad wrap around the arcuate edge 22. If attached to the pad 22 which has a flat or inwardly beveled edge 23, as is the case with prior art sanding pads, the projections 42 are designed to overhang the edge of the pad 21. (See FIG. 4).

The distance from the bottom of these valley portions 48 to the top 49 of the projections 42 can generally range anywhere from ¼th of an inch to ¾ inch with ⅜th to ½ inch preferred.

Preferably the central portion 36 of disk 12 includes a first arcuate slot 84 and a second arcuate slot 86 separated by first and second web portions 87 and 88. These arcuate slots are mirror images of each other and are spaced to lie over the portions of the annular groove 28 in the sanding pad. This makes it significantly easier to attach the pad and align these arcuate slots with the groove in the sanding pad as opposed to aligning holes with the groove. Further, these arcuate slots enable the vacuum system in the sander to suck in more dust providing for improved safety.

In use, the rotary sander of the present invention can be used as a normal sanding disk for sanding flat surfaces and exterior radiused surfaces. However, when one wishes to sand an interior radiused surface, one simply runs the sander so that the peak portions 42 engage the arcuate portion of the interior radiused surface. Sanding with the preferred embodiment the arcuate edge of the sanding pad 16 will press the projections against the interior radiused surface. However this is the preferred embodiment. It is not essential for practicing the present invention and the sanding disk of the present invention can also be used with a rotary sander having a straight or beveled edge as shown in FIG. 4.

Figure 3:
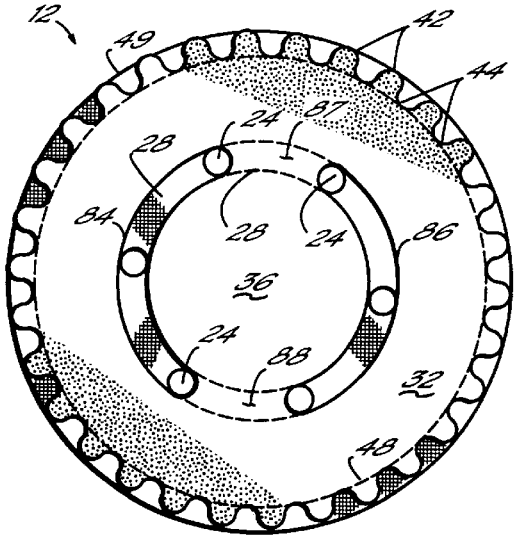
FIG. 3 is a bottom plan view of a sanding disk attached to a rotary sander.
Figure 3A:
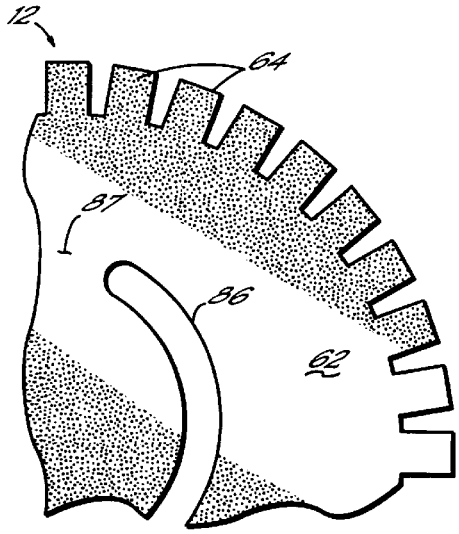
FIGS. 3A–3C are plan views, broken away of alternate embodiments of the present invention.
Figure 3B:
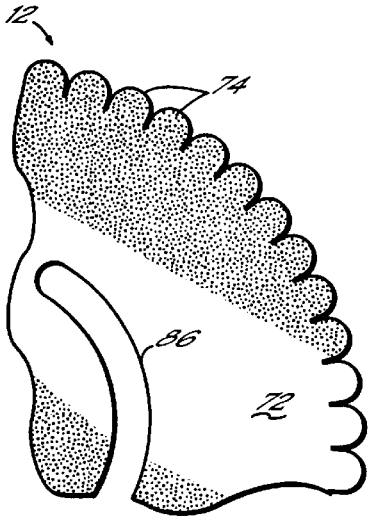
Figure 3C:
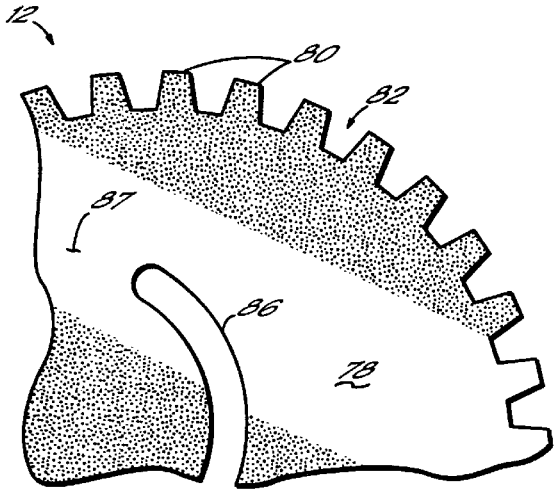

Alternate embodiments of the present invention are shown in FIGS. 3A–3C wherein the arcuate peaks and valleys of the disk 14 are replaced. In FIG. 3A disk 62 is shown having a rectangular projection 64. In FIG. 3B the disk 72 is shown with a scalloped outer edge 74. In FIG. 3C the disk 78 have truncated triangular peaks 80 and valleys 82. However the arcuate valleys and projections are preferred since these maximize the protection of the edge of the disk.

This has been a brief description of the present invention along with the preferred method of practicing the present invention. However, the invention itself should be defined by the appended claims wherein I claim:

What is claimed is:

1. A rotary sander having a pad, said pad having a flat circular surface, an edge, and a center body portion;

a sandpaper disk fixed to said pad;

said disk having a generally circular body portion and a circular edge whereon said circular body portion covers said pad;

said circular body portion having an abrasive surface and an opposite backside;

said opposite backside adapted to bond to said pad of said rotary sander;

said circular edge having spaced abrasive coated projections extended beyond said pad said projections adapted to flex over said edge of said pad to permit sanding inner radiused surfaces without gouging said inner radiused surfaces and without destroying said sandpaper disk;

wherein said projections, when flexed over said edge of said pad, are not secured to said edge of said pad by any additional component.

2. The sander claimed in claim 1 wherein said sanding pad has an arcuate edge beyond said flat surface of said pad wherein said projections of said sandpaper disk co-extend with said arcuate edge.

3. The rotary sander claimed in claim 1 wherein said sandpaper disk has two mirror image arcuate slots separated by two web portions whereby said sandpaper disk remains balanced about a central point.

4. The sander claimed in claim 1 wherein said projections comprise arcuate projections.

5. The rotary sander of claim 1 wherein said pad is comprised of a hook-type material and said opposite backside is comprised of felt.

* * * * *